US005856805A

United States Patent [19]

Page

[11] Patent Number: 5,856,805

[45] Date of Patent: Jan. 5, 1999

[54] ARRAY ANTENNA STEERING SYSTEM

[76] Inventor: Derrick J. Page, 1645 Severn Chapel Rd., Crownsville, Md. 21032-1917

[21] Appl. No.: 20,112

[22] Filed: Feb. 6, 1998

[51] Int. Cl.[6] ..... H01Q 3/22

[52] U.S. Cl. ..... 342/375

[58] Field of Search ..... 342/375, 368

[56] References Cited

U.S. PATENT DOCUMENTS

| | | | |
|---|---|---|---|
| 4,885,589 | 12/1989 | Edward et al. | 342/175 |
| 5,325,102 | 6/1994 | Page | 342/375 |
| 5,347,288 | 9/1994 | Page | 342/375 |
| 5,374,935 | 12/1994 | Forrest | 342/368 |
| 5,721,556 | 2/1998 | Goutzoulis | 342/375 |

*Primary Examiner*—Theodore M. Blum
*Attorney, Agent, or Firm*—H. C. Lin

[57] ABSTRACT

An array antenna is steered by moving a set of optical filters of different optical lengths between a number of light signal sources and an array antenna elements. By changing the lengths, hence the time delays, of a plurality of the signal paths between the light signal source and the antenna array elements, the wave front can be steered. Each delay path comprises a selected fiber optic line and a fixed electrical delay line. In one embodiment the fiber optical lines assume a parabolic distribution in time delay. In another embodiment, the fiber optical lines assume a cosinusoidal distribution in time delay. Signals are fed to the fiber optic path through a laser diode and exit from the path through a photo-diode. The fiber optic lines are mounted on a rotatable disk, with two ends diametrically located at two different radii. The laser diodes are mounted on a stationary disk and are aligned with one end of the fiber optic line on the rotatable disk, and the photo-diodes are mounted on the same stationary disk and are aligned to the second end of the fiber optic line. The rotatable disk is actuated by stepping motor to insure alignment of the two disks.

19 Claims, 5 Drawing Sheets

ARRAY ANTENNA STEERING SYSTEM

This a co-pending application of application Ser. No. 09/017,099, filed Feb. 2, 1998.

BACKGROUND OF THE INVENTION

1. Field of the Invention

This invention relates to array antennas and is particularly concerned with providing time delay steering to array antenna elements.

2. Description of the Prior Art

An array antenna consists of a group of antenna elements uniformly spaced apart to form an array. The array can be used for transmitting a beam of microwave energy in a chosen direction or receiving a microwave signal from a particular direction. This beam steering is achieved by controlling the relative timing or phasing of the individual elements.

The most common means of steering a beam in an antenna array is to control the relative phase of the signal at the elements. For the case of a flat antenna array, if all the elements are operated in unison, the beam will be pointed in the boresight direction, which is the direction perpendicular to the plane of the array. If a linearly increasing phase shift is introduced across the face of the array, the beam will be deflected at some angle from the boresight direction. Such antenna systems, referred to as phased arrays, are employed in applications where it is required to steer the beam rapidly in space and where the use of parabolic dish antennas is not practical.

Controlling the relative phase of each of the antenna elements requires that each element contain a phase shifting device and that an electronic control system be used to control the phase of each of the elements. However, the wide scale use of phased arrays has been limited by the high cost of their complex circuitry. Furthermore, if the phase shifting circuit is adjusted to steer in a particular direction, this setting will only be valid for a particular frequency. Adjacent frequencies will be transmitted or received with directional errors, a phenomena known as squint. Therefore, known phase shifting techniques impose a limit on the frequency range of operation.

Another technique that is used to steer the beam in an array antenna is to control the relative timing of the transmitted or received signal at the array element. In the transmission mode, if the signal at each of the elements is emitted in unison, a wavefront is formed that is parallel to the plane of the array. The signal beam is directed perpendicular to the wavefront, therefore, when the signal is emitted from the antenna elements in unison, the beam is directed perpendicular to the plane of the array (the boresight direction). When the emission from the antenna elements is not in unison, but is varied in time along the array the angle of the wavefront relative to the plane of the array will change and the beam will be steered away from boresight. If, for example, the signal emission from any element relative to its nearest adjacent element is delayed a time t and each element is spaced a distance d apart, the steered angle $\phi$ between the boresight direction and the beam direction is given by the formula $\sin \phi = t\ c/d$, where c represents the velocity of electromagnetic propagation is space. True-time delay techniques allow antenna arrays to operate over extremely wide frequency ranges as the delay techniques are frequency independent.

The use of fiberoptic communication systems is known. A commercially available laser unit is used to convert a microwave signal to an amplitude modulated optical signal. The optical signal travels through the optical fiber to where it is converted back to a microwave signal by an optical detector and a microwave amplifier, which are commercially available.

Optical techniques have been suggested to control array elements. Schemes have been proposed to use a selection of optical fibers with lengths arranged in a binary or quadratic sequence and to switch in a series string combination to achieve a desired timing, This would result in a very complex control scheme employing thousands of optical fibers and optical switches for even the simplest array.

An optical commutator scheme using two sets of fiber optics, each having a parabolic distribution of lengths has been described in U.S. Pat. No. 5,347,288. By aligning these two sets of fibers and moving one set relative to the other, a linear and variable set of delay paths can be generated which can be incorporated into an antenna array to provide the timing needed to form and steer the beam. This scheme is difficult and costly to fabricate as it is necessary to align a large set of fiber optics end to end with a second set and to be able to reposition and realign each time the beam steering is adjusted.

SUMMARY OF THE INVENTION

An object of this invention is to provide a device that performs the steering and timing function for an antenna array. Another object of this invention is to provide a device which is easy and cost effective to fabricate.

These objects are achieved by using a timing scheme for a particular array antenna design is "hard wired" by having a set of optical fiber delay lines built into a movable element. The optical fiber delay lines of the movable element are of selected lengths and have first ends which are alignable to a set of optical sources. A second end of the movable fibers is alignable to a set of optical detectors. I refer to the movable set of optical fibers and the associated mechanism and components as an optical commutator. The detectors are connected via, amplifiers to a set of electrical delay lines having selected lengths. The input RF signal is converted to a parallel set of identical optical signals. Each optical signal passes through one of the set of movable fibers to a detector. The detector converts the optical signal back to an RF signal, which is then fed through one of the set of electrical delay lines. In the case of a transmitter, the signal is fed to the respective radiating element. In the case of a receiver, the signal is combined with signals from other receiving elements to form the composite received signal.

As the movable element is moved, each of the parallel optical signals is transmitted through a selected optical delay path to the radiating element in the case of a transmitter and from the receiver amplifier in the case of a receiver. By controlling the amount of time delay to or from each antenna element, a beam may be formed and steered.

In a first preferred embodiment, the hard-wired optical delay lines are built onto a rotor disk. The first end terminates on one face of the disk and the second end also terminates on the same face, but at a different radius from the first A stator is provided. The stator is a second disk having an axis common with the rotor disk. The stator disk is fitted with a first set of optical sources evenly spaced around a particular radius. The stator disk is also fitted with a set of optical detectors evenly spaced around a different radius from that of the optical sources.

The positioning of the optical sources, optical detectors and fiber optics on the rotor are such that light may pass from the light source to the first end of the fiber optic and from the second end of the fiber optic to the optical detector. By rotating the rotor a different fiber optic having a different length may be imposed between the light source and the detector. Likewise, all other light sources and detector pairs will be coupled with different fiber optics lengths. Each detector is fitted with an electrical delay line, preferable of stripline or microstrip to provide signal timing delay. Alternatively, each light source may be fed by an electrical delay line to provide the relative timing. The rotor is preferably fitted with a stepping motor. By providing each element of the array a signal delay path composed of an optical delay line in series with an electrical delay line, the precise timing can be achieved to form the antenna beam. By mechanically indexing the rotor, the direction of the antenna beam may be steered in space.

The optical commutator may be employed in a transmitting antenna or a receiving antenna or both. The antenna elements may be arranged in a linear array, in a two dimensional array or in a circular array.

Other objects and advantages of the invention will become apparent from the description of certain present preferred embodiments thereof shown in the drawings.

DETAILED DESCRIPTION OF THE PREFERRED EMBODIMENT

Figure 1:
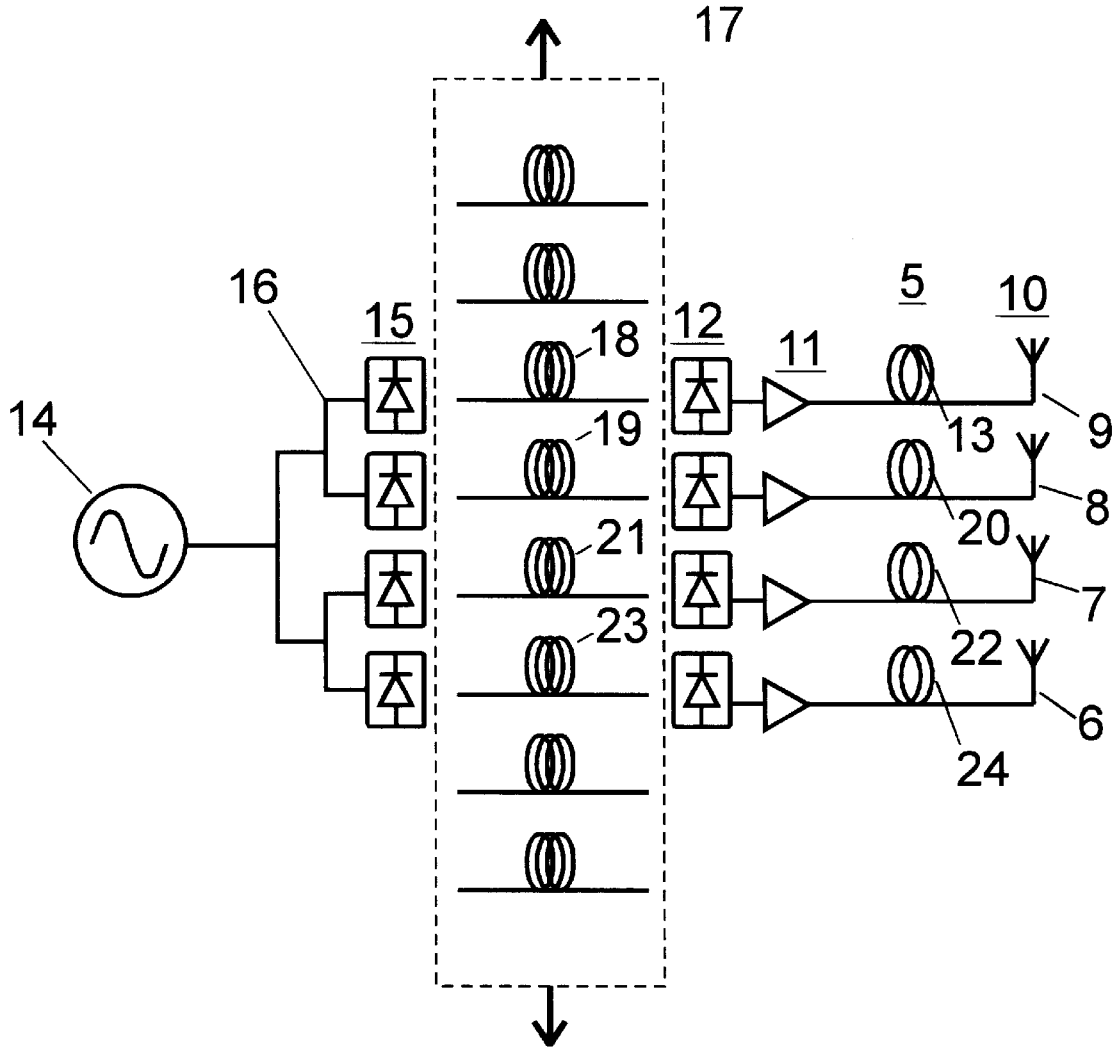
FIG. 1 is a schematic representation of a transmitter employing a beam steering mechanism.

Referring to FIG. 1, a circuit schematic is shown of a transmitter employing an antenna array 10 consisting of a set of radiating elements 6,7,8 and 9.

A frequency power source, 14 provides the signal frequency that is to be transmitted. The frequency source is fed to optical sources 15 via a divider network 16. Each of the sources 15 give out an amplitude modulated optical signal that is representative of the electrical frequency source 14. The optical signals from each of the light sources is then caused to pass through one of a collection of movable optical fibers 17. These optical fibers act as delay lines. The light emanating from each of the fiber then passes to one of a group of optical detectors 12, where the optical signals are converted back to electrical signals. Each signal is then amplified by a set of amplifiers 11 and fed via a set of electrical delay lines 5 to radiating elements that comprise an array antenna 10.

The timing of the radiation from a particular element in the array is governed by the delay in each of the parallel paths and is determined by the combined lengths of the optical delay line and the electrical delay line in that path.

In the case where the combined lengths causes an identical delay in each of the parallel paths, the signal arriving at each of the radiating elements will be time synchronous and will cause the elements to emit in unison. In the case where the antenna elements are arranged in a straight line, the radiation from the array will be perpendicular to the array.

Again, in the case of a planar antenna array with the elements arranged with uniform spacing, if the signals feeding the elements have a specific timing relationship, the radiation from the array can be directed in a particular direction. To steer the beam at a particular angle $\phi$, away from the boresight, the needed time delay of any element relative to its neighbor is governed by the equation $$t=d\ \sin\phi/c$$

where c is the speed of light in free space and d is the element spacing.

Referring to FIG. 1, the combined time delay introduced by optical fiber delay line 18 in series with electrical delay line 13 must be greater than the time delay introduced by the series combination of the time delay due to optical fiber delay line 19 in series with electrical delay line 20 by an amount t in order to steer the beam at angle $\phi$ from the boresight. Similarly, optical fiber delay line 21 in series with electrical delay line 22 must introduce a time delay which is greater by 2t. Similarly the combination of 23 and 24 must introduce a delay of 3t. and so on for all the element in a row on the antenna array.

To steer the beam to other directions the value of t must be changed. This is achieved by making the optical fibers have a distribution of delay time that varies in a parabolic fashion and making the electrical delay lines have a distribution in delay time that is the inverse of that of the optical delay lines. One set can be physically moved relative to the other to achieve the linear variation in delay time across the array. This is best understood by referring to the histogram of FIG. 2.

Figure 2A:
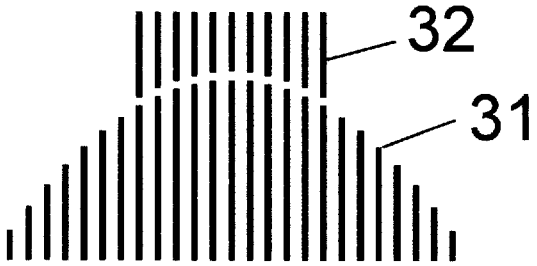
FIG. 2A is a representation of the alignment of the rotor optical fiber delay lines and the electrical delay lines in the boresight setting for a linear array.
Figure 2B:
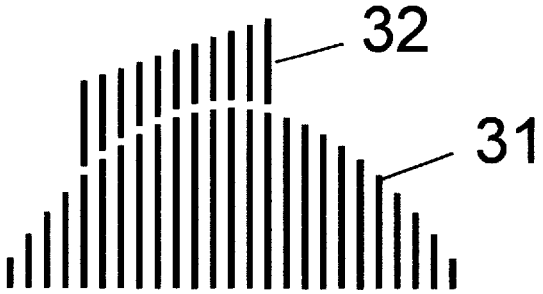
FIG. 2B is a representation of the alignment of the rotor optical fiber delay lines and the electrical delay lines in the steer right setting for a linear array
Figure 2C:
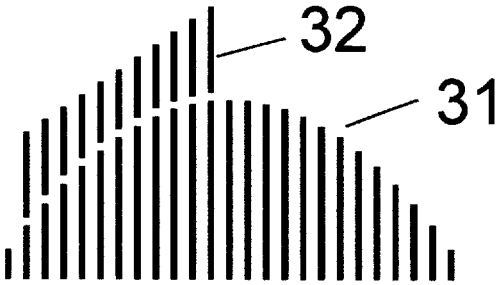
FIG. 2C is a representation of the alignment of the rotor optical fiber delay lines and the electrical delay lines in the steer far right setting for a linear array

In FIG. 2 the length of the histogram bars represent delay time. FIG. 2(*a*) shows a parabolic set of electrical delay lines 32 lined up with a set of optical fiber delay lines 31 so that the combined lengths are all the same. This situation corresponds to an antenna beam pointing in the boresight direction.

FIG. 2(*b*) shows the same two sets of delay lines as in FIG. 2(*a*), but with one set moved relative to the other. In this case the combined delay times form a linear distribution in time delay. This situation corresponds to the antenna beam pointing at an angle away from boresight.

FIG. 2(*c*) again shows the same two sets of delay lines but with one set moved further relative to the other. Again the combined time delays form a linear distribution but with a more pronounced variation than FIG. 2(*b*). This corresponds to the antenna beam pointing further away from boresight. Hence, by employing two sets of delay lines and each having a parabolic distribution, a linear but variable delay can be obtained by moving one set relative to the other.

Referring back to FIG. 1, the set of optical fiber delay lines 17 can be moved or indexed relative to the remainder of the components to achieve a linear but variable time delay of the signals being fed to the antenna elements. Moving the delay lines 17 causes the antenna to steer in space.

Figure 3:
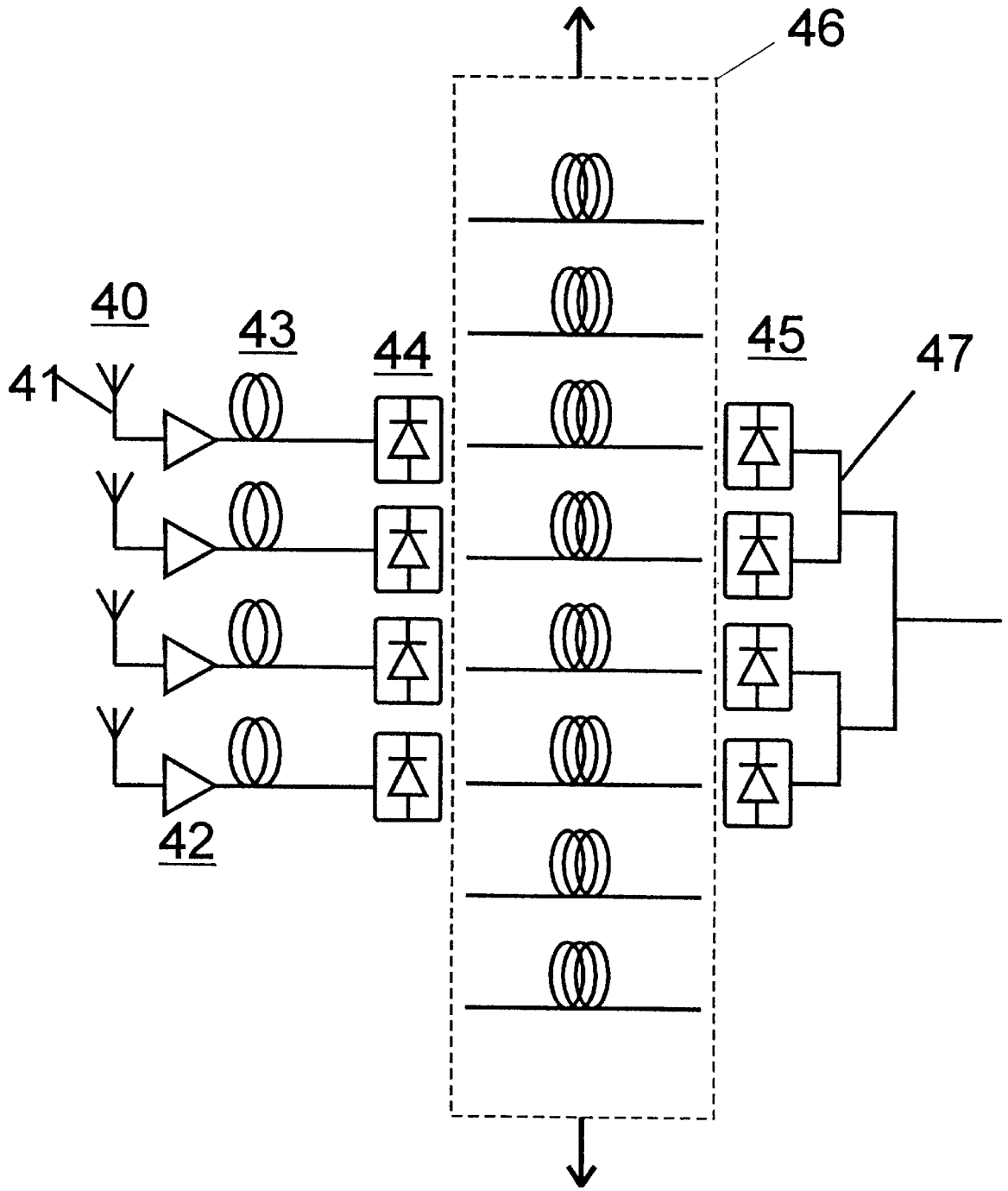
FIG. 3 is a schematic representation of a receiver employing a beam steering mechanism.

FIG. 3 is a schematic representation of a receiver employing an antenna array. Antenna 41 is one of many identical antennas in the antenna array 40. The received signal from element 41 is amplified by amplifier 48, being one of a group of amplifiers 42 and then passes through electrical delay line 49 of group 43 to light source 50 of light source group 44. Light source 50 can be preferable a laser diode or a light-emitting diode. The light source produces an amplitude modulated light beam that is representative of the received signal. The light from the light source is then passed through the optical fiber delay line 52, which is one of a movable set 46, to optical detector 51 being one of a set 45. The detector converts the optical signal back to an electrical signal. This signal is then combined with other parallel signals passing through the system in the combining network 47. The signal in the output of the combining network is the vector sum of the signals received by each of the antenna elements.

If the transit time from each of the antenna elements to the output of the combiner network is identical, then signals received simultaneously by each of the receiving elements will added vectorially in the output and correspond to a signal being received on boresight. Signals arriving from other directions will undergo destructive interference ill the output If a time shift is imposed in a sequential manner on the various parallel channels, the system will favor the reception of a signal from a selected direction. In a similar fashion to the transmitter system of FIG. 1 the receiver system of FIG. 3 can steer the received beam by moving the set of optical fiber delay lines 46.

Figure 4:
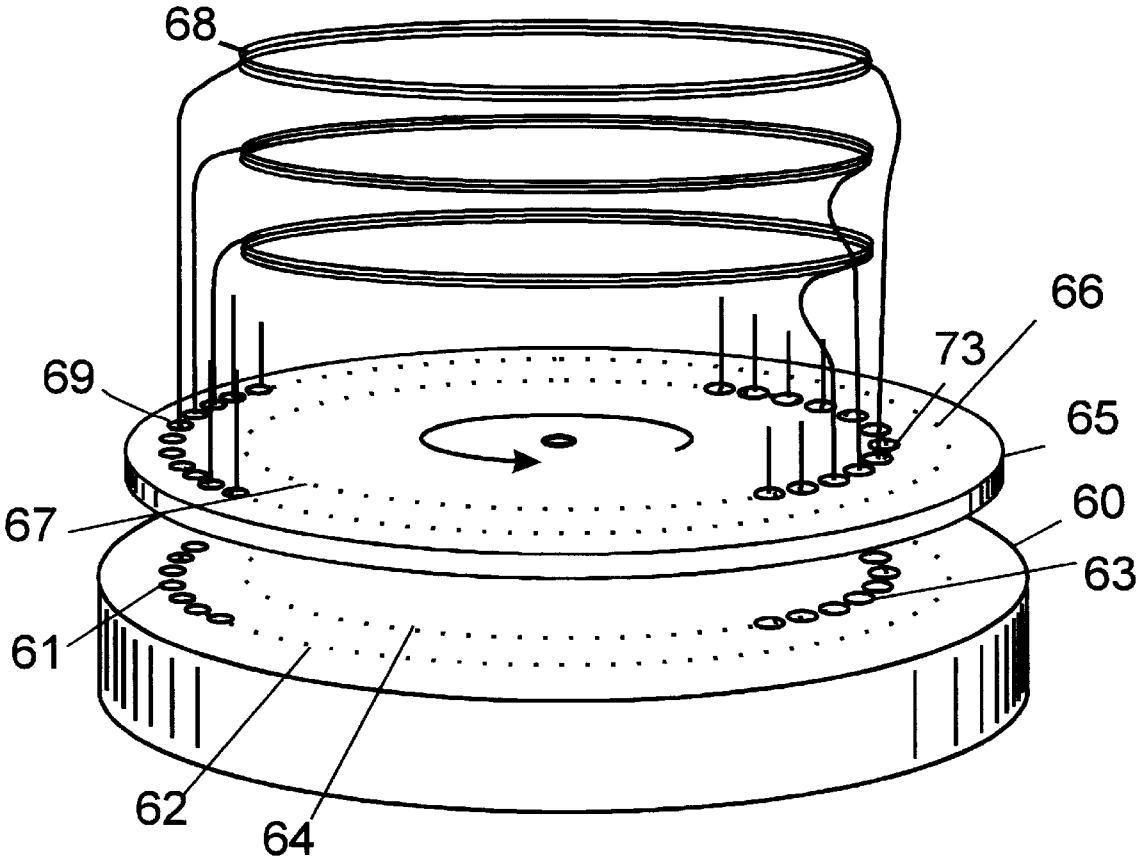
FIG. 4 is an exploded perspective of a preferred optical commutator.

FIG. 4 shows an exploded view of the preferred embodiment of the optical commutator. Within the stator 60 are incorporated a set of optical sources such as laser diodes 61 arranged at even intervals around a circle 62. A set of optical detectors 63 are also Arranged on a circle 64. The angular separation of the light sources and detectors are identical.

Above the stator and sharing the same axis is a rotor 65 which houses a set of optical fibers. One end of each of the optical fibers is terminated on a circle 66 which is of the same diameter as circle 62. The other end of each of the optical fibers is terminated on a circle 67 which has the same diameter as circle 64. One end of each fiber terminates in holes 69 in the plate such that light may pass from the light source 61, and pass through the optical fiber 68. The other end of the optical fiber is terminated in a hole on the rotor plate such that the light may pass from the optical fiber to the optical detector 63. Other optical fibers are terminated in other pairs of holes in the rotor plate.

If the optical fibers are of small diameter it has been found difficult to achieve the mechanical accuracy required to transfer the light into and out of the optical fiber. The ends of the optical fibers may be fitted with lenses to focus the light into and from the ends of the optical fibers.

The lengths of the optical fibers are arranged to be in a parabolic sequence.

The rotor can be rotated by a mechanical drive such as a stepping motor or a servo motor so that the set of optical light sources and optical detectors can come into alignment with different portions of the set of optical fibers.

As the fiber optic delay line is bidirectional, it should be recognized that a transmitter and receiver may share the same set of optical fibers.

If the antenna elements are arrange on an arc of a circle instead of a straight line, the parabolic set of optical fiber delay lines may be replaced by a set with a cosine distribution of lengths. In this case the electrical delay lines will all be the same length.

Figure 5A:
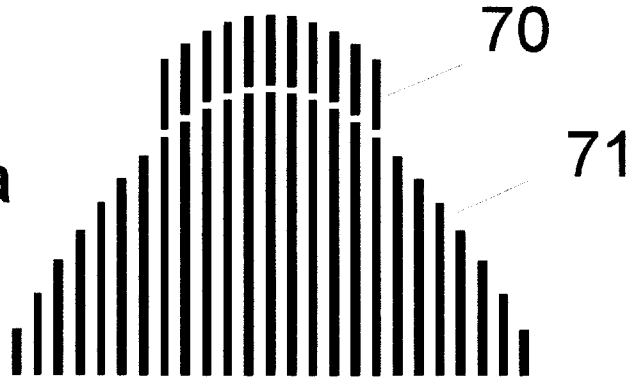
FIG. 5A is a representation of the alignment of the rotor optical fiber delay lines and the electrical delay lines in the boresight setting for an array having the elements arranged on the arc of a circle.
Figure 5B:
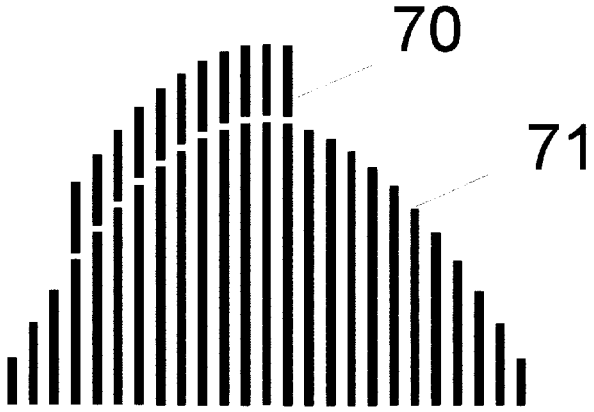
FIG. 5B is a representation of the alignment of the rotor optical fiber delay lines and the electrical delay lines in the steer right setting for an array having the elements arranged on the arc of a circle.
Figure 5C:
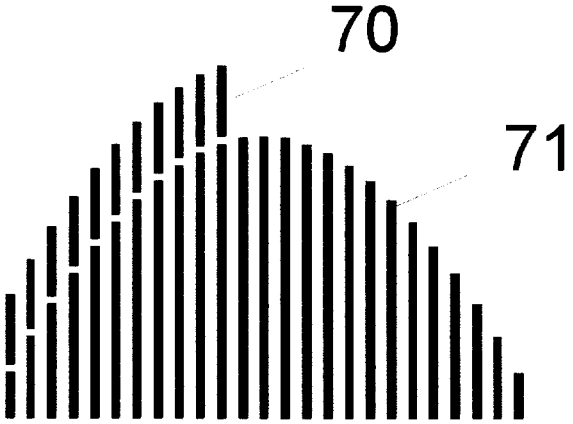
FIG. 5C is a representation of the alignment of the rotor optical fiber delay lines and the electrical delay lines in the steer far right setting for an array having the elements arranged on the arc of a circle

FIG. 5 shows the histogram of the distribution of delay times required for an array with antenna elements placed on an arc. The set of electrical delay lines 70 all have the same delay. The set of optical fiber delay lines have a cosinusoidal distribution of time delays. FIGS. 5(*b*) and 5(*c*) show two examples of the combined time delay of the electrical and optical delay lines when optical fibers are moved to steer the beam away from boresight.

It is also recognized that the set of optical sources such as laser diodes may be replaced by a single or fewer number of light sources that employ fiberoptic beam splitters to provide the modulated light that feeds to the movable set of optical fibers in the transmitter system. While the foregoing embodiment is described for the commutation of two circular disks, the concept is not limited to relative circular motion. For instance, commutation can be achieved with linear relative motion.

While certain present preferred embodiments have been shown and described, it is distinctly understood that the invention is not limited thereto but may be otherwise embodied within the scope of the following claims.

What is claimed is:

1. A device for delaying signals coupled to elements of an array antenna, the device providing delay paths of selectable length between the respective said elements and an electronic unit, the device comprising:

a set of optical lines, each fiber optic line having a first end, a second end and a selected length inserted between a first photoelectric device and a second photoelectric device which is coupled to said electronic unit;

a set of electrical delay lines each coupling said first photoelectric device to one of said elements of said antenna array; and means for moving the set of optical lines with respect to all of said first photoelectric device and all of said second photoelectric device.

2. A device for delaying signals as described in claim 1, wherein said means for moving rotates concentrically said set of optical lines with respect to all of said first photoelectric device and all of said second photoelectric device.

3. A device for delaying signals as described in claim 2, wherein said set of optical lines are mounted on a rotatable disk and all of said first photoelectric device and said second photoelectric device are mounted on a stationary disk.

4. A device for delaying signals as described in claim 3, wherein said first end of said fiber optic line is connected along a circle of first radius and said second end of said fiber optic line is connected along a circle of second radius, and said first photoelectric device is mounted along a circle of said first radius and said second photoelectric device is mounted along a circle of said second radius.

5. A device for delaying signals as described in claim 4, further comprising means for aligning a said first end of said fiber optic line with a said first photoelectric device and aligning a said second end of said fiber optic line with a said second photoelectric device.

6. A device for delaying signals as described in claim 5, wherein said means for aligning uses a servo motor.

7. A device for delaying signals as described in claim 5, wherein said means for aligning uses stepping motor.

8. A device for delaying signals as described in claim 1, wherein said electrical delay line uses a stripline.

9. A device for delaying signals as described in claim 1, wherein said electrical delay line uses a coaxial cable.

10. A device for delaying signals as described in claim 1, wherein said set of optical line has a parabolic distribution in time delays sequentially, and said electrical delay line has a sequential distribution of time delays which complements the optical line when the antenna is radiating in a direction perpendicular co the plane of said elements.

11. A device for delaying signals as described in claim 1, wherein said electronic unit is a signal generating source, said first photoelectric device is a laser diode and said second photoelectric device is a photo-diode.

12. A device for delaying signals as described in 10, further comprising an amplifier connected between said photo-diode and said electrical delay line.

13. A device for delaying signals as described in claim 10, further comprising a divider network connected between said signal generating source and all of said laser diode.

14. A device for delaying signals as described in claim 1, wherein said electronic unit is a receiver, said first photoelectric device is a laser diode and said second photoelectric device is a photo-diode.

15. A device for delaying signals as described in claim 13, wherein every one of said photo-diode is connected to a combining network for feeding said receiver.

16. A device for delaying signals as described in claim 13, further comprising an amplifier between each of said elements and a corresponding said electrical delay line.

17. A device for delaying signals as described in claim 1, wherein said electronic unit may be selected between a transmitting unit and a receiving unit, and said set of optical lines and said set of electrical delay lines are shared when said electrical unit functions both as said transmitting unit and as said receiving unit.

18. A device for delaying signals as described in claim 1, wherein said set of optical lines has a sequential cosinusoidal distribution of time delays, and all of the set of electrical delay lines have the same delay.

19. A method of delaying signals coupled to respective elements of an antenna array, comprising the steps of:

providing a set of optical lines, each having a first end, a second end and a selected length inserted between a first photoelectric device and a second photoelectric device which is coupled to said electronic unit;

providing a set of electrical delay lines, each coupling said first photoelectric device to one of said elements of said antenna array; and moving the set of optical lines with respect to all of said set of photoelectric device and all of said second photoelectric device.

* * * * *